US010549980B2

(12) United States Patent
Varini

(10) Patent No.: US 10,549,980 B2
(45) Date of Patent: Feb. 4, 2020

(54) SYSTEM AND METHOD FOR CONTROLLING THE DISPENSING OF FUEL BY A DISTRIBUTION APPARATUS

(71) Applicant: PIUSI S.P.A., Suzzara (IT)

(72) Inventor: Otto Varini, Suzzara (IT)

(73) Assignee: PIUSI S.P.A., Suzzara (IT)

( * ) Notice: Subject to any disclaimer, the term of this patent is extended or adjusted under 35 U.S.C. 154(b) by 0 days.

(21) Appl. No.: 15/649,432

(22) Filed: Jul. 13, 2017

(65) Prior Publication Data

US 2018/0016131 A1 Jan. 18, 2018

(30) Foreign Application Priority Data

Jul. 18, 2016 (IT) ..... 102016000074605

(51) Int. Cl.
*B67D 7/34* (2010.01)
*B67D 7/14* (2010.01)
*G07F 13/02* (2006.01)

(52) U.S. Cl.
CPC ..... *B67D 7/34* (2013.01); *B67D 7/145* (2013.01); *G07F 13/025* (2013.01)

(58) Field of Classification Search
CPC ..... B67D 7/34; B67D 7/145; G07F 13/025
USPC ..... 700/231–244
See application file for complete search history.

(56) References Cited

U.S. PATENT DOCUMENTS 9,135,615 B1 * 9/2015 Mutha ..... G06Q 20/325
10,210,696 B2 2/2019 Bretthauer
2007/0106543 A1 * 5/2007 Baughman ..... G06Q 10/06311 705/7.21
2009/0070175 A1 * 3/2009 Bauqhman ..... G06Q 10/0631 705/7.12
2009/0099724 A1 * 4/2009 Kranz ..... G01F 1/115 701/33.4
2010/0023162 A1 * 1/2010 Gresak ..... B67D 7/08 700/241
2012/0223829 A1 9/2012 Tyler
2014/0195044 A1 * 7/2014 McQuade ..... H04L 9/3215 700/237
2014/0195045 A1 * 7/2014 McQuade ..... H04L 9/3215 700/237

(Continued)

FOREIGN PATENT DOCUMENTS

WO 2015/071770 5/2015

OTHER PUBLICATIONS

Italian Search Report, IT 201600074605, dated May 22, 2017.

*Primary Examiner* — Michael Collins

(57) ABSTRACT

A system for controlling the dispensing of fuel by a distribution apparatus, particularly for private use, which comprises one or more dispensing units, one or more mobile processing devices operated by respective driver users, and a central remote processing device; the mobile devices are in communication with the central remote device by way of a telematic communications network; the dispensing units and the mobile processing devices comprise respective short-range wireless communication modules that are adapted to establish a short-range wireless communication session between the dispensing units and the mobile devices, the mobile devices being adapted and configured to allow the transmission of data originating from the dispensing units to the central remote processing device.

19 Claims, 3 Drawing Sheets

(56) References Cited

U.S. PATENT DOCUMENTS

| | | | | |
|---|---|---|---|---|
| 2014/0195046 | A1* | 7/2014 | Fadler | H04L 9/3215 700/237 |
| 2014/0195047 | A1* | 7/2014 | King | H04L 9/3215 700/237 |
| 2014/0327778 | A1* | 11/2014 | McQuade | G08G 1/0175 348/156 |
| 2015/0106196 | A1* | 4/2015 | Williams | G06Q 20/227 705/14.51 |
| 2015/0242855 | A1* | 8/2015 | Vilnai | B67D 7/34 705/44 |

* cited by examiner

SYSTEM AND METHOD FOR CONTROLLING THE DISPENSING OF FUEL BY A DISTRIBUTION APPARATUS

The present invention relates to a system and a method for controlling the dispensing of fuel by a distribution apparatus, particularly, although not exclusively, useful and practical in the area of fuel distribution systems for private use, used for example by companies operating in the goods transport and logistics sector, or in the delivery sector, for refueling its motor vehicles.

Currently, fuel distribution systems are typically provided with one or more dispensing units or pumps, each dispensing unit being adapted to refuel a motor vehicle of a user, i.e. adapted to dispense the fuel, for example gasoline, Diesel fuel, LPG or the like, into the tank of such motor vehicle driven by such user, for example a driver who works for a transport company.

The refueling operation involves stopping the motor vehicle in a suitable area proximate to a dispensing pump, inserting the dispenser or dispensing nozzle of the pump into the inlet that gives access to the tank of the motor vehicle proper, and commencing the dispensing of fuel.

However, conventional fuel distribution systems, particularly for private use, are not devoid of drawbacks, among which is the fact that these conventional solutions, which as mentioned are typically adopted by transport companies, lead to operations to refuel motor vehicles that are often indiscriminate and uncontrolled, in particular because no payment is necessary before or after dispensing the fuel.

In fact, conventional fuel distribution systems, particularly for private use, do not track or record in any way the many refueling operations performed using them. Any of the users who have access to one of these conventional systems can perform an indefinite number of motor vehicle refueling operations without such operations being in any way tracked or recorded.

Another drawback consists in that refueling operations performed using conventional fuel distribution systems, particularly for private use, are completely dissociated from the actual distance traveled, and as a consequence the actual fuel consumption, of the refueled motor vehicle. In practice, for example, a motor vehicle of a transport company might have been previously refueled with enough fuel to travel a distance of at least 1,000 kilometers, but returns for refueling after only 100 kilometers.

A further drawback of conventional fuel distribution systems, particularly for private use, consists in that they do not offer a user in charge, for example the owner or the manager of a transport company, the ability to monitor the refueling operations performed using these systems, and consequently to monitor fuel consumption in general, and the fuel consumption of a specific motor vehicle in particular.

The aim of the present invention is to overcome the above mentioned drawbacks of the known art, by devising a system and a method for controlling the dispensing of fuel by a distribution apparatus, particularly for private use, which make it possible to obtain levels of efficacy and efficiency in the refueling of motor vehicles that are superior to those that can be obtained with conventional solutions and/or similar levels of efficacy and efficiency at lower cost.

Within this aim, an object of the present invention is to conceive a system and a method for controlling the dispensing of fuel by a distribution apparatus, particularly for private use, which make it possible to track and control the amount of fuel dispensed in each instance to refuel a specific motor vehicle driven by a specific user.

Another object of the present invention is to devise a system and a method for controlling the dispensing of fuel by a distribution apparatus, particularly for private use, which make it possible to associate the amount of fuel dispensed in each instance to refuel a specific motor vehicle with the actual distance traveled of such specific motor vehicle.

Another object of the present invention is to conceive a system and a method for controlling the dispensing of fuel by a distribution apparatus, particularly for private use, which make it possible to take advantage of suitable reports, in real time or otherwise, that is of primary importance for monitoring, by a user in charge, of the refueling operations performed using the system, and consequently of fuel consumption in general, and of the fuel consumption of a specific motor vehicle in particular.

Another object of the present invention is to devise a system and a method for controlling the dispensing of fuel by a distribution apparatus, particularly for private use, which make it possible to carry out a check of the accesses of the users to the system, as a consequence increasing the general level of security in the system.

Another object of the present invention is to provide a system for controlling the dispensing of fuel by a distribution apparatus that is highly reliable, easily and practically implemented and low cost.

This aim and these and other objects which will become better apparent hereinafter are achieved by a system for controlling the dispensing of fuel by a distribution apparatus, particularly for private use, which comprises one or more dispensing units, one or more mobile processing devices operated by respective driver users, and a central remote processing device, said mobile devices being in communication with said central remote device by way of a telematic communications network, characterized in that said dispensing units and said mobile processing devices comprise respective short-range wireless communication modules that are adapted to establish a short-range wireless communication session between said dispensing units and said mobile devices, said mobile devices being adapted and configured to allow the transmission of data originating from said dispensing units to said central remote processing device.

The aim and objects are also achieved by a method for controlling the dispensing of fuel by a distribution apparatus, particularly for private use, characterized in that it comprises the steps of:

- establishing a short-range wireless communication session between a dispensing unit and a mobile device that is operated by a driver user;
- authenticating said driver user by verifying the correct identity of said driver user;
- beginning the dispensing of the fuel in order to refuel his or her motor vehicle by said driver user;
- ending the dispensing of the fuel in order to refuel his or her motor vehicle by said driver user;
- transmitting data relating to the fuel dispensing operation, said transmission being divided into two legs: first from said dispensing unit to said mobile device and then from said mobile device to a central remote processing device;
- storing said data relating to the fuel dispensing operation, by said central remote processing device.

Further characteristics and advantages of the invention will become better apparent from the detailed description of a preferred, but not exclusive, embodiment of the system and of the method for controlling the dispensing of fuel by a distribution apparatus according to the invention, which is illustrated by way of non-limiting example in the accompanying drawings, wherein.

Figure 1:
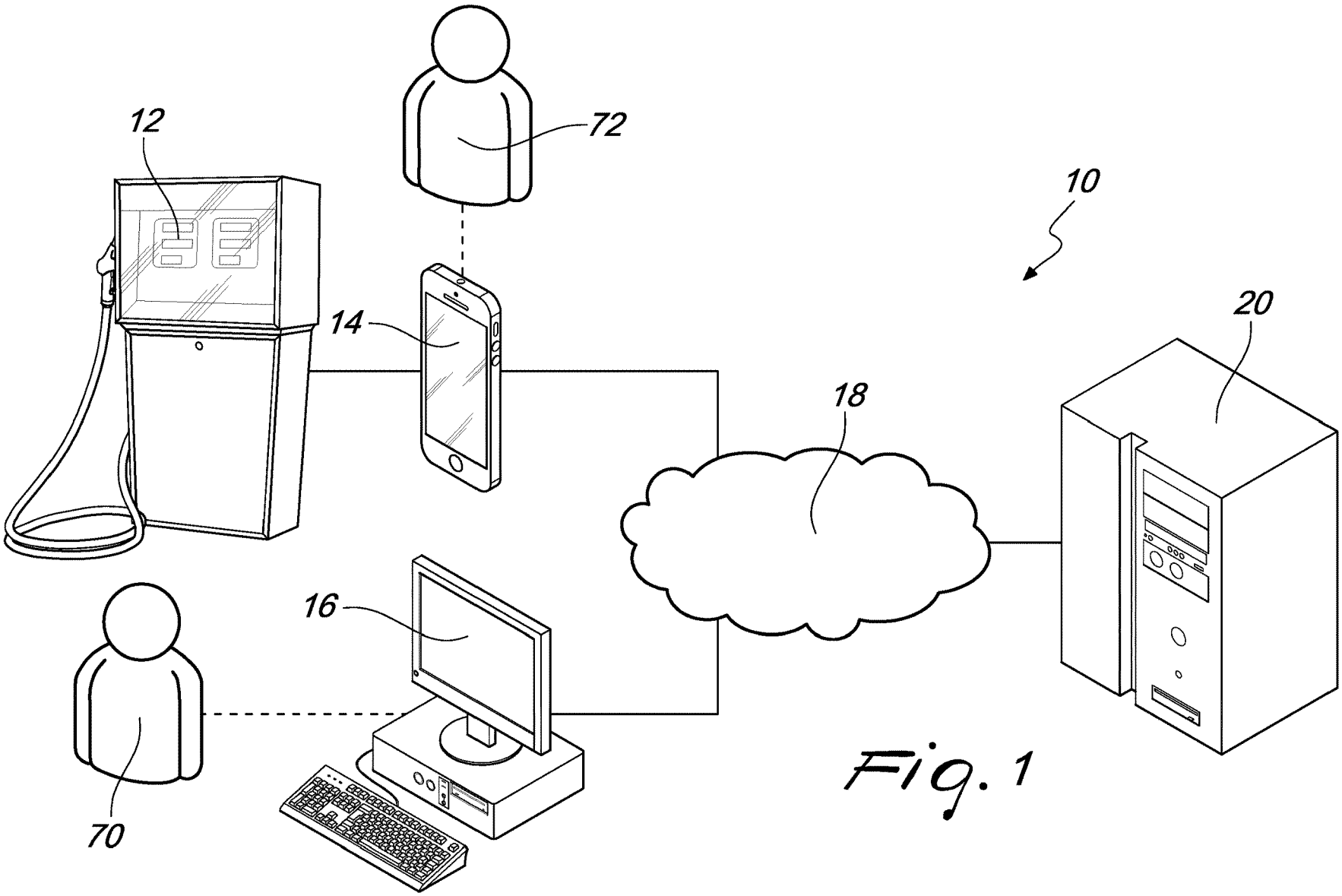
FIG. 1 is a diagram that schematically illustrates an embodiment of the system for controlling the dispensing of fuel by a distribution apparatus, according to the present invention.
Figure 3:
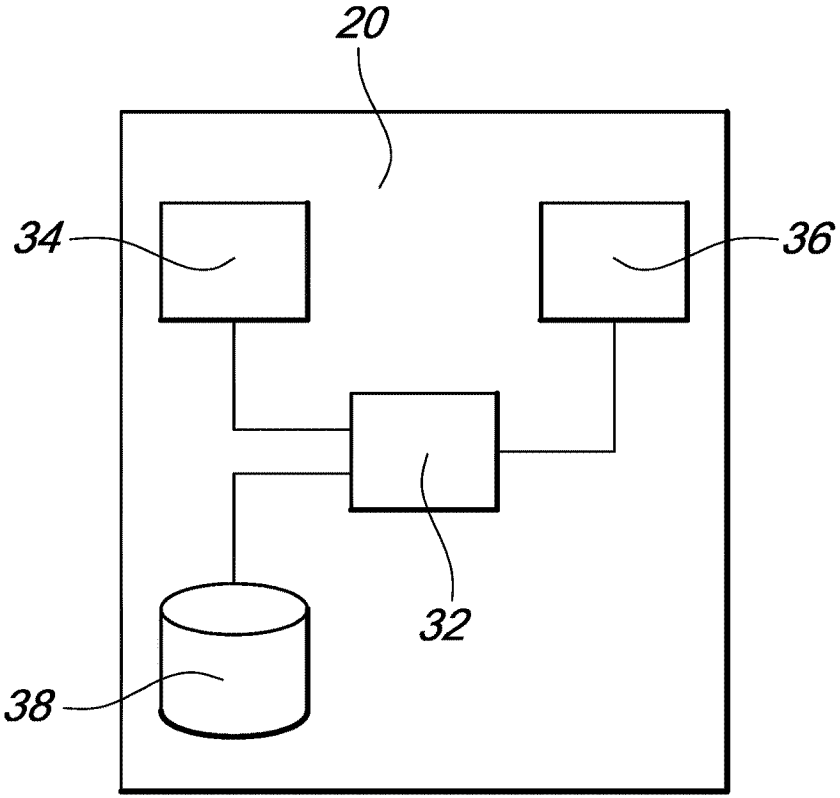
FIG. 3 is a block diagram that schematically illustrates an embodiment of the central remote processing device of a system for controlling the dispensing of fuel by a distribution apparatus, according to the present invention.
Figure 2:
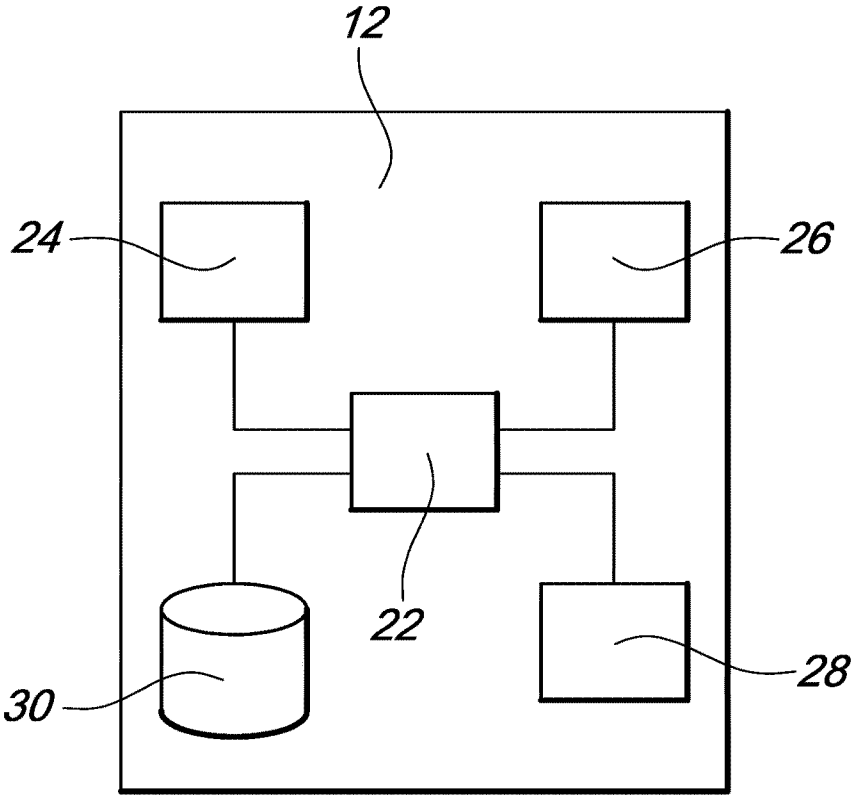
FIG. 2 is a block diagram that schematically illustrates an embodiment of the dispensing unit of a system for controlling the dispensing of fuel by a distribution apparatus, according to the present invention.

With reference to the figures, the system for controlling the dispensing of fuel by a distribution apparatus, particularly for private use, according to the invention, generally designated by the reference numeral 10, comprises substantially one or more dispensing units 12, one or more mobile processing devices 14, at least one operator processing device 16, and a central remote processing device 20.

Note that, in the present invention, the dispensing units 12 can be situated at great distances from each other, such as for example in different cities, but also in different regions or even in different countries.

The mobile device 14, such as for example a smartphone or a tablet computer, is operated by a driver user 72 of the system 10 according to the invention, such as for example a driver working for a transport company, who carries out the refueling of his or her motor vehicle when necessary.

The operator device 16, such as for example a desktop computer but also a smartphone or a tablet computer, is operated by a user in charge 70 of the system 10 according to the invention, such as for example the owner or the manager of a transport company, who supervises the refueling operations performed using the system and monitors the fuel consumption.

The dispensing unit 12 comprises a control unit or controller 22, dispensing means 24, a short-range wireless communication module 26, authentication means 28, and local storage means 30.

The control unit or controller 22 is the main functional element of the dispensing unit 12 of the system 10 for controlling the dispensing of fuel by a distribution apparatus according to the invention; in fact, the control unit 22 is connected to and in communication with the other operational and/or functional elements comprised in the dispensing unit 12.

The controller 22 is provided with adapted processing capacity and capacity to interface with the other elements of the dispensing unit 12 of the system 10 according to the invention, and it is adapted to command, manage and coordinate the operation of the elements of the dispensing unit 12 with which it is connected and in communication, and to execute the operations to process the data arriving from such elements of the dispensing unit 12 and/or from the mobile device 14, and return the corresponding results to them.

The dispensing means 24 of the dispensing unit 12 are adapted to take the fuel from a tank connected thereto by way of a conduit, and to dispense the fuel thus taken into the tank of a motor vehicle.

The dispensing means 24 comprise at least one pumping device or pump, and at least one dispenser or dispensing nozzle. In an embodiment of the system 10 for controlling the dispensing of fuel by a distribution apparatus according to the invention, the dispensing means 24 comprise a pump and a dispensing nozzle for each type of fuel available: for example, a first pump and a first dispensing nozzle for gasoline, a second pump and a second dispensing nozzle for Diesel fuel, and so on.

The short-range wireless communication module 26 of the dispensing unit 12, preferably of the Bluetooth type, and even more preferably of the BTLE (Bluetooth Low Energy) type, is adapted for the connection and communication, preferably bidirectional, of the dispensing unit 12 with the mobile device 14.

In the preferred embodiment of the system 10 according to the invention, wherein the short-range wireless communication module 26 of the dispensing unit 12 is of the Bluetooth type, the Bluetooth module 26 can integrate a microcontroller that is adapted to manage the Bluetooth communication with the mobile device 14, according to the corresponding protocols, and is adapted to manage the radio transmission through an antenna provided directly on the printed circuit.

The authentication means 28 of the dispensing unit 12 are adapted to authenticate the driver user 72, by verifying the correct identity of such user who wishes to perform the refueling of his or her motor vehicle; in the event of a positive outcome, and if the authenticated user is included in the list of registered and authorized driver users 72, authorizing that user to use the dispensing unit 12 to perform the aforementioned refueling.

In a preferred embodiment of the system 10 for controlling the dispensing of fuel by a distribution apparatus according to the invention, the authentication means 28 comprise an iButton device reader, which is adapted to detect and recognize a plurality of unique iButton devices in the possession of the driver users 72. Each driver user 72 has his or her own unique iButton device.

The iButton device is a chip contained in a small, strong housing that is resistant to atmospheric agents, typically made of stainless steel.

The iButton device uses its metallic housing as an electronic communication interface: the housing has a data contact, called the "lid", and a ground contact, called the "base". Each one of these contacts is connected to the silicon chip inside the housing. The lid is in the upper part of the housing, while the base constitutes the side walls and the bottom of the housing and can comprise a flange in order to simplify attaching the iButton to any object.

Each iButton device has a unique and unmodifiable address etched onto its chip inside the metallic housing. The address (for example 2700000095C33108) can be used as a key or an identifier for each iButton device and, in the present invention, makes it possible to uniquely identify the driver user 72.

The dispensing unit 12 can be configured to enable the dispensing of fuel in order to refuel a motor vehicle only ever following the positive outcome of the authentication of the driver user 72 by way of the above mentioned authentication means 28, and if the authenticated user is included in the list of driver users 72 who are registered and authorized at the dispensing unit 12.

The local storage means 30 of the dispensing unit 12 are adapted to store all the information and the data corresponding to the dispensing unit 12, and which therefore refer to all the refueling operations performed at it.

By way of example, the local storage means 30 can store the following information and data: list of the driver users 72 who are registered and authorized at the dispensing unit 12, identification code of the refueling event, date and time of the refueling event, amount of fuel dispensed in the refueling event, identification code of the driver user 72 who carried out the refueling, name and surname of the driver user 72 who carried out the refueling, registration plate of the motor vehicle refueled in the refueling event, make and/or model of the motor vehicle refueled in the refueling event, total distance traveled (for example total kilometers or miles) of the motor vehicle refueled in the refueling event.

The data stored in the local storage means 30, or a selection thereof, can be transmitted from the dispensing unit 12 to the central remote processing device 20 by way of the mobile device 14, as explained in more detail below in the present description.

In particular, the local storage means 30 of the dispensing unit 12 can comprise a database adapted to store a list of driver users 72 who are registered and authorized at that dispensing unit 12, so that the driver user 72 can obtain authorization to use the dispensing unit 12, in order to refuel his or her motor vehicle with fuel, even if the signal or the connection with the telematic communications network 18 for communicating with the central remote processing device 20 is temporarily unavailable.

In an embodiment of the system 10 for controlling the dispensing of fuel by a distribution apparatus according to the invention, the local storage means 30 of the dispensing unit 12 comprise a database stored on conveniently dimensioned memory media.

In a preferred embodiment of the system 10 for controlling the dispensing of fuel by a distribution apparatus according to the invention, the dispensing unit 12 further comprises a fuel level sensor, which is positioned in the tank associated with the dispensing unit 12, and is connected to and in communication with the controller 22.

In this case, among the data transmitted by the dispensing unit 12 to the central remote processing device 20, there can also be the value of the level of fuel contained in the tank, detected by the aforementioned level sensor.

The mobile processing device 14, which as mentioned is constituted for example by a smartphone or a tablet computer, is capable of processing information and data in response to instructions provided by the driver user 72 or by third-party devices, as well as executing software applications or modules installed therein.

The mobile device 14 is provided with suitable processing capacity and for interfacing with third-party devices connected to it, such as for example the central remote processing device 20 which can be reached by way of a telematic communications network 18.

The mobile device 14 is in communication with the central remote device 20 by way of a telematic communications network 18, such as for example the internet. The mobile device 14, therefore, comprises means for connection to and communication with the central remote device 20, by way of the telematic communications network 18.

The mobile device 14 is adapted and configured to allow the transmission of data originating from the dispensing unit 12 to the central remote processing device 20, but also the reception of data originating from the central remote processing device 20 and intended for the dispensing unit 12, for example relating to the synchronization of the list of driver users 72 who are registered and authorized at that dispensing unit 12, or relating to the configuration of the operating parameters of the latter. Such transmission and such reception of data occur through the telematic communications network 18.

Note that in the system 10 for controlling the dispensing of fuel by a distribution apparatus according to the invention, the mobile device 14 does not necessarily have to be connected to the telematic communications network 18 except during transmission of data to the central remote processing device 20 or reception of data originating from it, the system 10 according to the invention being therefore able to operate even, for example, in the absence of a signal or connection with the telematic communications network 18.

In a preferred embodiment of the system 10 according to the invention, each mobile device 14 is assigned exclusively to a corresponding driver user 72, who carries out the refueling operations of his or her motor vehicle.

In a preferred embodiment of the system 10 according to the invention, each mobile device 14 comprises a unique identification code that enables the dispensing unit 12 and/or the central remote processing device 20 to distinguish it from the other mobile devices 14, as a consequence identifying the corresponding driver user 72.

The mobile device 14 comprises a short-range wireless communication module, preferably of the Bluetooth type, and even more preferably of the BTLE (Bluetooth Low Energy) type, which is adapted for the connection and communication, preferably bidirectional, of the mobile device 14 with the dispensing unit 12.

In the preferred embodiment of the system 10 according to the invention, wherein the short-range wireless communication module of the mobile device 14 is of the Bluetooth type, such Bluetooth module can integrate a microcontroller that is adapted to manage the Bluetooth communication with the dispensing unit 12, according to the corresponding protocols, and is adapted to manage the radio transmission through an antenna provided directly on the printed circuit.

In order to establish a short-range wireless communication session, preferably bidirectional, between them, the dispensing unit 12 and the mobile device 14 are configured to execute pairing operations, i.e. the process of mutual recognition that for example takes place when two Bluetooth devices are connected to each other, and which consists of exchanging and verifying a unique identification code, in order to authorize the subsequent exchange of data between those devices.

In other words, once the dispensing unit 12 and the mobile device 14, and in particular the respective short-range wireless communication modules, are arranged at a suitable distance (for example within a range of 10-15 meters) or even substantially in contact, they exchange handshaking information, such as for example a unique identification code that enables mutual recognition.

In an embodiment of the system 10 for controlling the dispensing of fuel by a distribution apparatus according to the invention, the dispensing unit 12 comprises signaling means that are adapted to signal the status of the mutual recognition or pairing to the driver user 72, which for example comprise a luminous green indicator light for signaling the positive outcome of the pairing and/or a luminous red indicator light for signaling the negative outcome of the pairing.

The dispensing unit 12 can be configured to enable the dispensing of fuel in order to refuel a motor vehicle only ever following the positive outcome of the aforementioned mutual recognition or pairing between the dispensing unit 12 and the mobile device 14, and if the user in possession of the recognized mobile device 14 is included in the list of driver users 72 who are registered and authorized at the dispensing unit 12.

In a preferred embodiment of the system 10 for controlling the dispensing of fuel by a distribution apparatus according to the invention, the driver user 72 is authorized and enabled to use the dispensing unit 12 to perform the refueling of his or her motor vehicle only ever following the positive outcome of a "combined" authentication, comprising both the authentication of the driver user 72 by way of the authentication means 28 (for example an iButton) of the dispensing unit 12, and the authentication of the driver user 72 by way of the mutual recognition or pairing between the dispensing unit 12 and the mobile device 14 in the possession of that driver user 72; again, on condition that the driver user 72 in question is included in the list of driver users 72 who are registered and authorized at the dispensing unit 12.

Advantageously, the driver user 72 is not enabled to use the dispensing unit 12 to perform the refueling of his or her motor vehicle indefinitely; this permission, in fact, is limited in time and its duration corresponds to a period of time that can be adjusted by the user in charge 70. When the period of time of the permission reaches its end, the driver user 72 will no longer be enabled to dispense fuel at the dispensing unit 12, without a new operation to authenticate, authorize, and enable that driver user.

Advantageously, the system 10 for controlling the dispensing of fuel by a distribution apparatus according to the invention, and in particular the dispensing unit 12, is configured to manage an authentication queue that comprises a plurality of driver users 72 who want to perform the refueling of their motor vehicle. In this manner, each individual refueling operation is associated with the driver user 72 that actually performed it, thus preventing for example a refueling operation from being incorrectly associated with a driver user 72 who did not perform this operation.

In a preferred embodiment of the system 10 for controlling the dispensing of fuel by a distribution apparatus according to the invention, the mobile device 14 is configured and comprises means of entering, by the driver user 72, the total distance traveled, i.e. the value of the odometer (total number of kilometers or total number of miles), of his or her motor vehicle at refueling time.

In an embodiment, entering the total distance traveled of one's motor vehicle at refueling time is done after the pairing between the dispensing unit 12 and the mobile device 14, or following a specific request made by the driver user 72 using his or her mobile device 14.

In an embodiment, entering the total distance traveled of one's motor vehicle at refueling time is done using a suitable screen of a graphical interface displayed on the mobile device 14 and implemented using an adapted app intended for mobile devices.

In an embodiment of the invention, the system 10 for controlling the dispensing of fuel by a distribution apparatus, in particular the dispensing unit 12 and/or the central remote device 20, is configured to check that the total distance traveled thus entered by the driver user 72 at refueling time is greater than the total distance traveled that was entered previously.

In essence, the system 10 according to the invention verifies that there has been an increase in the distance traveled, by at each refueling operation checking the value (for example stored in the local storage means 30 of the dispensing unit 12) of the last total distance traveled entered by the driver user 72, in order to prevent the driver user 72 from making mistakes during the new entry. By way of example, if the value of the last total distance traveled entered is 100,000 kin, the driver user 72 will be prevented from entering the value 10,000 kin at the subsequent refueling operation.

The operator processing device 16, which as mentioned is constituted for example by a desktop computer but also by a smartphone or a tablet computer, is capable of processing information and data in response to instructions provided by the user in charge 70 or by third-party devices, as well as executing software applications or modules installed therein.

The operator device 16 is provided with suitable processing capacity and for interfacing with third-party devices connected to it, such as for example the central remote processing device 20 which can be reached by way of the telematic communications network 18.

The operator device 16 is in communication with the central remote device 20 by way of a telematic communications network 18, such as for example the internet. The operator device 16, therefore, comprises means for connection to and communication with the central remote device 20, by way of the telematic communications network 18.

The operator device 16 is adapted and configured to enable the user in charge 70 to interact with the central remote processing device 20. By way of example, the operator device 16 interfaces with the central remote processing device 20, offering the user in charge 70 the ability to: create and update the information and data stored in the local storage means 30 of the dispensing units 12 or in the remote storage means 38 of the central remote processing device 20 proper, synchronize the list of driver users 72 who are registered and authorized at the dispensing units 12, configure the operating parameters of the dispensing units 12, and request and display summary tables and charts generated by the report module 36.

In a preferred embodiment of the system 10 according to the invention, if the operator device 16 is a desktop computer, it can be provided with a web browser, such as for example Mozilla Firefox, Google Chrome or Microsoft Internet Explorer, for displaying a graphical interface of the web type (web application).

In another embodiment of the system 10 according to the invention, if the operator device 16 is a smartphone or a tablet computer, it can be provided with an adapted app intended for mobile devices to implement a graphical interface.

The central remote processing device 20 is a server system, preferably a web server, and comprises a control unit 32, interface means 34, a report module 36, and remote storage means 38.

The central remote processing device 20 further comprises means for connection and communication with the mobile processing device 14 and with the operator processing device 16, by way of the telematic communications network 18.

The control unit 32 is the main functional element of the central remote device 20 of the system 10 for controlling the dispensing of fuel by a distribution apparatus according to the invention; in fact, the control unit 32 is connected to and in communication with the other operational and/or functional elements comprised in the central remote processing device 20.

The control unit 32 is provided with adapted processing capacity and for interfacing with the other elements of the central remote processing device 20 of the system 10 according to the invention, and it is adapted to command, manage and coordinate the operation of the elements of the central remote device 20 with which it is connected and in communication, and to execute the operations to process the data arriving from such elements of the central remote device 20, from the mobile device 14 and/or from the operator device 16, and return the corresponding results to them.

The interface means 34 are the means with which the user in charge 70 interacts in input and in output with the central remote processing device 20. In essence, the interface means 34 offer as output a plurality of information in the form of screens that the user in charge 70 can in each instance select and display using the operator processing device 16.

By way of example, the interface means 34 of the central remote processing device 20 offer the user in charge 70 the ability to: create and update the information and data stored in the local storage means 30 of the dispensing units 12 or in the remote storage means 38 of the central remote processing device 20 proper, synchronize the list of driver users 72 who are registered and authorized at the dispensing units 12, configure the operating parameters of the dispensing units 12, and request and display summary tables and charts generated by the report module 36.

In a preferred embodiment of the system 10 according to the invention, if the operator device 16 is a desktop computer, the interface means 34 of the central remote processing device 20 can comprise a graphical interface of the web type (a web application) displayed on the operator device 16, which is provided with a web browser such as for example Mozilla Firefox, Google Chrome or Microsoft Internet Explorer.

In another embodiment of the system 10 according to the invention, if the operator device 16 is a smartphone or a tablet computer, the interface means 34 of the central remote processing device 20 can comprise a graphical interface displayed on the operator device 16, implemented by an adapted app intended for mobile devices.

The report module 36 is adapted to produce and provide, starting from what is stored in the remote storage means 38, information and statistical data on the refueling operations taken together and individually, preferably producing summary tables and charts of the refueling operations performed by the driver users 72.

The report module 36 provides detailed information, delayed or in real time, on the refueling operations performed using the system and on the amount of fuel dispensed, including for example the number of refueling operations performed by a specific driver user 72 or at a specific dispensing unit 12, or the amount of fuel dispensed by an individual dispensing unit 12 or by a plurality of dispensing units 12, all in chart form and in table form.

This can be done for example on the basis of a time interval, on the basis of the city or geographic area, on the basis of the driver user 72 (for example by filtering on the identification code), on the basis of the motor vehicle (for example filtering on the registration plate), on the basis of the type of fuel, or indeed on the basis of the dispensing unit 12.

The report module 36 further makes it possible to keep the reports produced, by storing them in the remote storage means 38.

The remote storage means 38 are adapted to store all the information and data for the system 10 overall, and therefore all the information and data relating to all the refueling operations performed at all the dispensing units 12, which are transmitted from the mobile devices 14 to the central remote processing device 20 through the telematic communications network 18.

By way of example, the remote storage means 38 can store the following information and data: list of the driver users 72 who are registered and authorized at each dispensing unit 12, identification code of each dispensing unit 12, identification code of the refueling event, date and time of the refueling event, amount of fuel dispensed in the refueling event, identification code of the driver user 72 who carried out the refueling, name and surname of the driver user 72 who carried out the refueling, registration plate of the motor vehicle refueled in the refueling event, make and/or model of the motor vehicle refueled in the refueling event, total distance traveled (for example total kilometers or miles) of the motor vehicle refueled in the refueling event.

Furthermore, the remote storage means 38 can store an account or profile associated with each user in charge 70 or driver user 72, and an account or profile associated with each dispensing unit 12.

In a preferred embodiment of the system 10 for controlling the dispensing of fuel by a distribution apparatus according to the invention, the remote storage means 38 comprise a database stored on conveniently dimensioned memory media.

In an embodiment of the system 10 for controlling the dispensing of fuel by a distribution apparatus according to the invention, the remote storage means 38 can be external to the central remote processing device 20; in this case, the central remote device 20 further comprises means of interfacing with the remote storage means 38.

Figure 4:
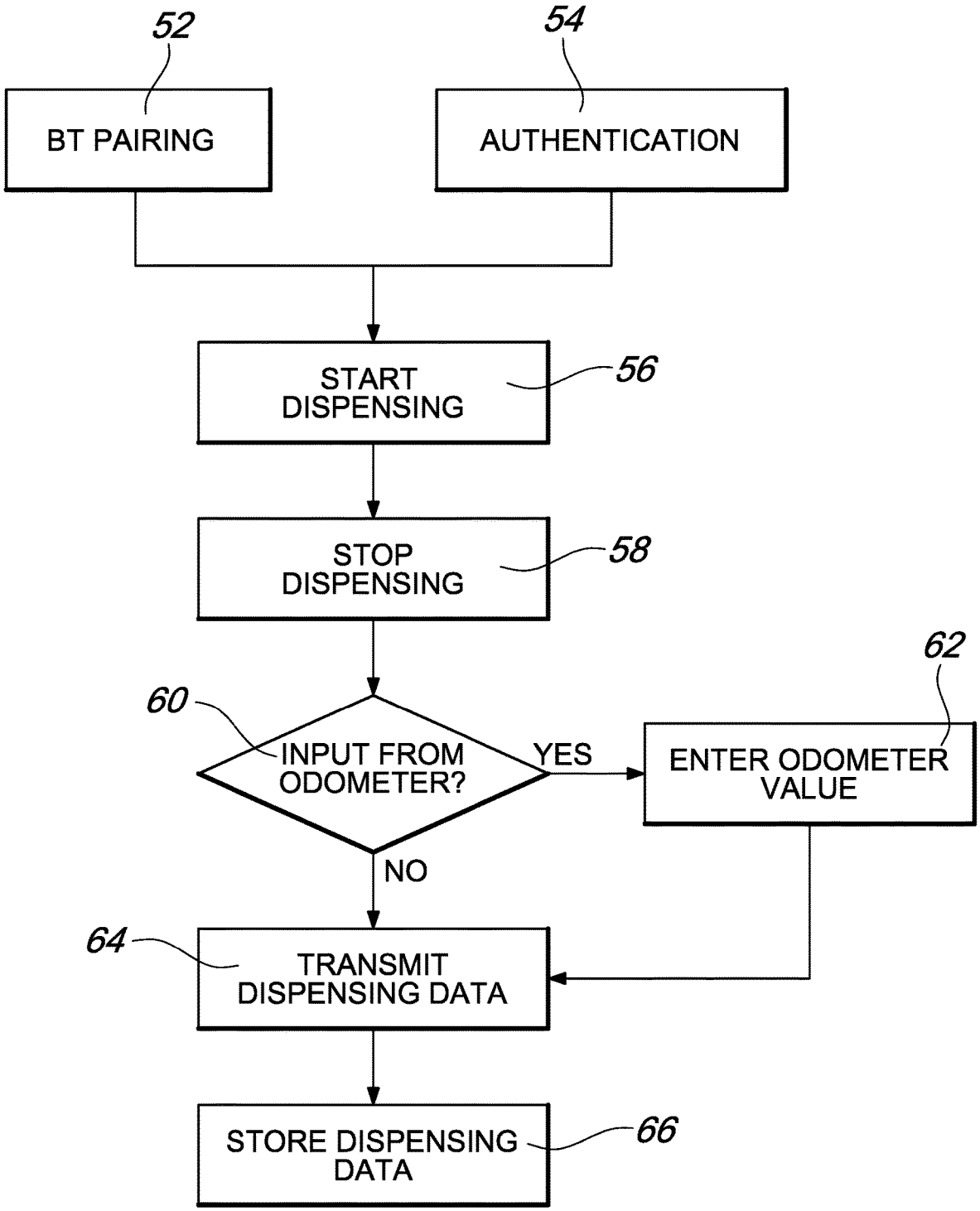
FIG. 4 is a flow chart that illustrates an embodiment of the method for controlling the dispensing of fuel by a distribution apparatus, according to the present invention.

A possible operation of an embodiment of the system 10 for controlling the dispensing of fuel by a distribution apparatus, particularly for private use, according to the invention, will now be described with reference to FIG. 4.

Initially, in step 52, in order to establish a short-range wireless communication session, preferably bidirectional, between them, the dispensing unit 12 and the mobile device 14, and in particular the respective short-range wireless communication modules, which are arranged at a suitable distance (for example within a range of 10-15 meters), execute pairing operations, i.e. the process of mutual recognition that for example takes place when two Bluetooth devices are connected to each other, and which consists of exchanging and verifying a unique identification code, in order to authorize the subsequent exchange of data between those devices.

The dispensing unit 12 can be configured to enable the dispensing of fuel in order to refuel a motor vehicle only ever following the positive outcome of the aforementioned mutual recognition or pairing between the dispensing unit 12 and the mobile device 14, and if the user in possession of the recognized mobile device 14 is included in the list of driver users 72 who are registered and authorized at the dispensing unit 12.

At the same time, in step 54, the authentication means 28, which comprise for example an iButton device reader adapted to detect and recognize a plurality of unique iButton devices, authenticate the driver user 72, verifying the correct identity of such user who wants to perform the refueling of his or her motor vehicle and, if the outcome is positive, authorizing him or her to use the dispensing unit 12 to perform the aforementioned refueling.

The dispensing unit 12 can be configured to enable the dispensing of fuel in order to refuel a motor vehicle only ever following the positive outcome of the authentication of the driver user 72 by way of the above mentioned authentication means 28, and if the authenticated user is included in the list of driver users 72 who are registered and authorized at the dispensing unit 12.

In a preferred embodiment of the system 10 for controlling the dispensing of fuel by a distribution apparatus according to the invention, the driver user 72 is authorized and enabled to use the dispensing unit 12 to perform the refueling of his or her motor vehicle only ever following the positive outcome of a "combined" authentication, comprising both the authentication of the driver user 72 by way of the authentication means 28 (for example an iButton) of the dispensing unit 12, and the authentication of the driver user 72 by way of the mutual recognition or pairing between the dispensing unit 12 and the mobile device 14 in the possession of that driver user 72; again, on condition that the driver user 72 in question is included in the list of driver users 72 who are registered and authorized at the dispensing unit 12.

Advantageously, the driver user 72 is not enabled to use the dispensing unit 12 to perform the refueling of his or her motor vehicle indefinitely; this permission, in fact, is limited in time and its duration corresponds to a period of time that can be adjusted by the user in charge 70. When the period of time of the permission reaches its end, the driver user 72 will no longer be enabled to dispense fuel at the dispensing unit 12, without a new operation to authenticate, authorize, and enable that driver user.

Advantageously, the system 10 for controlling the dispensing of fuel by a distribution apparatus according to the invention, and in particular the dispensing unit 12, is configured to manage an authentication queue that comprises a plurality of driver users 72 who want to perform the refueling of their motor vehicle. In this manner, each individual refueling operation is associated with the driver user 72 that actually performed it, thus preventing for example a refueling operation from being incorrectly associated with a driver user 72 who did not perform this operation.

Once the above mentioned steps 52 and 54 have been carried out, i.e. after the communication between the dispensing unit 12 and the mobile device 14 has been set up and after the driver user 72 has been authenticated, in step 56 the authorized driver user 72 proceeds with the dispensing of the fuel in order to refuel his or her motor vehicle.

In step 58 the authorized driver user 72 finishes dispensing the fuel to refuel his or her motor vehicle.

Then, in step 60, the system checks whether or not the driver user 72 wants to enter, in the system 10 according to the invention, the total distance traveled of his or her motor vehicle at refueling time, the total distance traveled being a useful data item for any subsequent calculation of the fuel consumption of the motor vehicle.

If so, then in step 62 the driver user 72, using the mobile device 14, enters the total distance traveled, i.e. the value of the odometer (total number of kilometers or total number of miles), of his or her motor vehicle at refueling time. If not, then execution proceeds directly to the subsequent step 64.

Note that in this first part of the operation of the system 10 for controlling the dispensing of fuel by a distribution apparatus according to the invention, i.e. during steps 52, 54, 56, 58, 60 and 62 described above, the mobile device 14 does not necessarily have to be connected to the telematic communications network 18, and the system 10 according to the invention can therefore operate up to here even, for example, in the absence of a signal or connection with the telematic communications network 18.

In step 64 the data on the fuel dispensing operation just performed is transmitted, and this transmission is divided into two legs: first from the dispensing unit 12 to the mobile device 14 in the possession of the driver user 72, through the short-range wireless communication network (for example Bluetooth), and then from the mobile device 14 to the central remote processing device 20, through the telematic communications network 18 (for example the internet).

In an embodiment of the system 10 for controlling the dispensing of fuel by a distribution apparatus according to the invention, the aforementioned transmission does not comprise exclusively the data for the fuel dispensing operation just performed, but also comprises the data for the previous N fuel dispensing operations, independently of the driver user 72 who performed them, if they have not yet been transmitted for example owing to the earlier absence of a signal or a connection with the telematic communications network 18.

By way of example, if the driver user 72 has the mobile device 14 switched off, or does not have a mobile device 14 at all, such that he or she has no way of establishing a connection with the telematic communications network 18, he or she can still perform the refueling of his or her motor vehicle, and the data for its fuel dispensing operation just performed will be transmitted by the next eligible driver user 72, i.e. by the next driver user 72 who is in possession of a mobile device 14 that enables the transmission of the above mentioned data to the central remote processing device 20.

In another embodiment of the system 10 for controlling the dispensing of fuel by a distribution apparatus according to the invention, the transmission of the data for the fuel dispensing operation just performed, and possibly also of the data for the previous N fuel dispensing operations, in particular the leg from the mobile device 14 to the central remote processing device 20, if they have not yet been transmitted for example owing to the earlier absence of a signal or a connection with the telematic communications network 18, occurs deferred over time as soon as the signal or the connection with the telematic communications network 18 is available.

By way of example, if in the area of the dispensing unit 12 there is no network signal, then as soon as the driver user 72 moves to another area where there is a network signal, the system 10 according to the invention, in particular the mobile device 14, will provide for the transmission of the data to the central remote processing device 20.

Finally, in step 66 the central remote processing device 20 stores, in particular in the remote storage means 38, the data on the fuel dispensing operation just received from the mobile processing device 14 in the possession of the driver user 72.

In practice it has been found that the invention fully achieves the set aim and objects. In particular, it has been seen that the system and the method for controlling the dispensing of fuel by a distribution apparatus, particularly for private use, thus conceived make it possible to overcome the limitations of the known art since they make it possible to obtain levels of efficacy and efficiency in the refueling of motor vehicles that are superior to those that can be obtained with conventional solutions and/or similar levels of efficacy and efficiency at lower cost, by remotely tracking and controlling the amount of fuel dispensed in each instance to refuel a specific motor vehicle driven by a specific user, and associating such amount of fuel dispensed in each instance to refuel a specific motor vehicle with the actual distance traveled of such specific motor vehicle.

Another advantage of the system and of the method for controlling the dispensing of fuel by a distribution apparatus, according to the present invention, consists in that they make it possible to take advantage of suitable reports, in real time or otherwise, that are of primary importance for monitoring, by a user in charge, of the refueling operations performed using the system, and consequently of fuel consumption in general, and of the fuel consumption of a specific motor vehicle in particular.

Another advantage of the system and of the method for controlling the dispensing of fuel by a distribution apparatus, according to the present invention, consists in that they make it possible to perform a check of the accesses by the driver users of the system, as a consequence increasing the general level of security in the system, in particular by virtue of the "combined" authentication.

Another advantage of the system and of the method for controlling the dispensing of fuel by a distribution apparatus, according to the present invention, consists in that they allow the driver users of the system to leave their mobile device in the motor vehicle during the refueling operations, since the driver user does not need to act on the mobile device during the refueling, as a consequence increasing the level of convenience in performing this operation.

Although the system and the method for controlling the dispensing of fuel by a distribution apparatus according to the invention have been conceived in particular for private use, for example for the refueling of motor vehicles used by companies operating in the goods transport and logistics sector, or in the delivery sector, it can also be used, more generally, in any fuel distribution apparatus used to refuel any motor vehicle.

The invention, thus conceived, is susceptible of numerous modifications and variations, all of which are within the scope of the appended claims; by way of non-limiting example, the person skilled in the art will understand without effort that a mechanical or electromechanical device can also be provided which can be actuated by a user to stop the dispensing of fuel in the event of an emergency. Moreover, all the details may be substituted by other, technically equivalent elements.

In practice, the materials used, as well as the contingent shapes and dimensions, may be any according to the requirements and the state of the art.

In conclusion, the scope of protection of the claims shall not be limited by the explanations or by the preferred embodiments illustrated in the description by way of examples, but rather the claims shall comprise all the patentable characteristics of novelty that reside in the present invention, including all the characteristics that would be considered as equivalent by the person skilled in the art.

The disclosures in Italian Patent Application No. 102016000074605 (UA2016A005260) from which this application claims priority are incorporated herein by reference.

What is claimed is:

1. A system for controlling the dispensing of fuel by a distribution apparatus, particularly for private use, which comprises one or more dispensing units, one or more mobile processing devices operated by respective driver users, and a central remote processing device, said mobile devices being in communication with said central remote processing device by way of a telematic communications network, wherein said dispensing units and said mobile processing devices comprise respective short-range wireless communication modules that are adapted to establish a short-range wireless communication session between said dispensing units and said mobile devices, said mobile devices being adapted and configured to allow the transmission of data originating from said dispensing units to said central remote processing device, wherein said dispensing units comprise local storage means, which comprise a database that is adapted to store a list of said driver users who are registered with and authorized at said dispensing units.

2. The system for controlling the dispensing of fuel by a distribution apparatus according to claim 1, wherein said short-range wireless communication modules comprised in said dispensing units and in said mobile processing devices are of the Bluetooth type.

3. The system for controlling the dispensing of fuel by a distribution apparatus according to claim 1, wherein said dispensing units comprise authentication means adapted to authenticate said driver users by verifying the correct identity of said driver users.

4. The system for controlling the dispensing of fuel by a distribution apparatus according to claim 3, wherein said authentication means comprise an iButton device reader that is adapted to detect and recognize a plurality of unique iButton devices in the possession of said driver users.

5. The system for controlling the dispensing of fuel by a distribution apparatus according to claim 3, wherein said authentication of said driver users occurs by pairing between said dispensing units and said mobile devices.

6. The system for controlling the dispensing of fuel by a distribution apparatus according to claim 1, wherein said dispensing units are configured to manage an authentication queue that comprises a plurality of said driver users.

7. The system for controlling the dispensing of fuel by a distribution apparatus according to claim 1, wherein said dispensing units comprise a fuel level sensor, which is arranged in a tank associated with said dispensing units.

8. The system for controlling the dispensing of fuel by a distribution apparatus according to claim 1, wherein said mobile devices comprise means for said driver users to enter the total distance traveled of their motor vehicle at refueling time.

9. The system for controlling the dispensing of fuel by a distribution apparatus according to claim 8, wherein it is configured to verify that the total distance traveled entered by said driver users at refueling time, by virtue of said means for entering the total distance traveled of said mobile devices, is greater than the total distance traveled that was entered previously.

10. The system for controlling the dispensing of fuel by a distribution apparatus according to claim 1, further comprising at least one operator processing device that is operated by a respective user in charge and is adapted and configured to allow said user in charge to interact with said central remote processing device, said at least one operator device being in communication with said central remote processing device by way of said telematic communications network.

11. The system for controlling the dispensing of fuel by a distribution apparatus according to claim 10, wherein said dispensing units comprise local storage means, wherein said operator processing device is adapted and configured to update the data stored in said local storage means of said dispensing units, or in remote storage means of said central remote processing device.

12. The system for controlling the dispensing of fuel by a distribution apparatus according to claim 10, wherein said operator processing device is provided with a web browser for displaying a graphical interface of the web or web application type.

13. A method for controlling the dispensing of fuel by a distribution apparatus, particularly for private use, comprising the steps of:

establishing a short-range wireless communication session between a dispensing unit and a mobile device that is operated by a driver user;

authenticating said driver user by verifying the correct identity of said driver user;

beginning the dispensing of the fuel in order to refuel his or her motor vehicle by said driver user;

ending the dispensing of the fuel in order to refuel his or her motor vehicle by said driver user;

transmitting data relating to the fuel dispensing operation, said transmission being divided into two legs: first from said dispensing unit to said mobile device and then from said mobile device to a central remote processing device;

storing said data relating to the fuel dispensing operation, by said central remote processing device; and storing on local storage means at said dispensing units a list of said driver users who are authenticated at said dispensing units.

14. The method for controlling the dispensing of fuel by a distribution apparatus according to claim 13, wherein said step of establishing a short-range wireless communication session between said dispensing unit and said mobile device comprises the step of performing pairing operations between said dispensing unit and said mobile device.

15. The method for controlling the dispensing of fuel by a distribution apparatus according to claim 13, wherein said step of authenticating said driver user comprises the step of authenticating said driver user by way of an iButton device reader, which is adapted to detect and recognize a plurality of unique iButton devices in the possession of said driver users.

16. The method for controlling the dispensing of fuel by a distribution apparatus according to claim 14, wherein said step of authenticating said driver user comprises the step of authenticating said driver user by way of said pairing between said dispensing unit and said mobile device.

17. The method for controlling the dispensing of fuel by a distribution apparatus according to claim 13, further comprising the step of entering the total distance traveled of one's motor vehicle at refueling time, by said driver user.

18. The method for controlling the dispensing of fuel by a distribution apparatus according to claim 13, wherein said step of transmitting data relating to the fuel dispensing operation also comprises data relating to the previous N fuel dispensing operations, if the latter have not yet been transmitted.

19. The method for controlling the dispensing of fuel by a distribution apparatus according to claim 13, wherein said step of transmitting data relating to the fuel dispensing operation that has just been performed and/or relating to the preceding N fuel dispensing operations, if the latter have not yet been transmitted, occurs in a deferred manner as soon as the signal or the connection with said telematic communications network is available.

* * * * *